US009192235B2

(12) United States Patent
Horowitz

(10) Patent No.: US 9,192,235 B2
(45) Date of Patent: Nov. 24, 2015

(54) ICHAIR

(71) Applicant: Brian Horowitz, Foothill Ranch, CA (US)

(72) Inventor: Brian Horowitz, Foothill Ranch, CA (US)

( * ) Notice: Subject to any disclaimer, the term of this patent is extended or adjusted under 35 U.S.C. 154(b) by 185 days.

(21) Appl. No.: 13/851,918

(22) Filed: Mar. 27, 2013

(65) Prior Publication Data

US 2014/0292041 A1 Oct. 2, 2014

(51) Int. Cl.

| | |
|---|---|
| ***A47C 1/14*** | (2006.01) |
| ***A47C 4/28*** | (2006.01) |
| ***A47C 7/66*** | (2006.01) |
| ***A47C 7/70*** | (2006.01) |

(52) U.S. Cl.

CPC . *A47C 1/14* (2013.01); *A47C 4/286* (2013.01); *A47C 7/66* (2013.01); *A47C 7/70* (2013.01); *Y10T 29/49826* (2015.01)

(58) Field of Classification Search

CPC ..... A41C 4/20
USPC ..... 297/45, 184.16, 135, 174 R, 170, 171, 297/172, 173

See application file for complete search history.

(56) References Cited

U.S. PATENT DOCUMENTS

| | | | | |
|---|---|---|---|---|
| 4,566,732 | A * | 1/1986 | Ostergaard et al. | 297/174 R |
| 5,850,843 | A * | 12/1998 | Mahood et al. | 135/88.06 |
| 5,882,070 | A * | 3/1999 | Genn | 297/174 R |
| 6,082,813 | A * | 7/2000 | Chen | 297/16.2 |
| 6,247,749 | B1 * | 6/2001 | Yu | 297/16.2 |
| 6,736,450 | B2 * | 5/2004 | Miyagi | 297/16.2 |
| 6,776,433 | B2 * | 8/2004 | Harrison et al. | 280/647 |
| 6,899,383 | B2 * | 5/2005 | Hwang | 297/16.2 |
| 7,281,759 | B1 * | 10/2007 | Strong et al. | 297/45 |
| 7,631,654 | B2 * | 12/2009 | Blumenthal et al. | 135/16 |
| 7,669,881 | B2 * | 3/2010 | Haury et al. | 280/649 |
| 7,878,585 | B2 * | 2/2011 | Salisbury | 297/180.14 |
| 8,091,962 | B2 * | 1/2012 | Quinn | 297/184.16 |
| 8,388,056 | B2 * | 3/2013 | Smith et al. | 297/180.12 |
| 8,726,921 | B2 * | 5/2014 | Wilkins | 135/25.4 |
| 8,864,223 | B2 * | 10/2014 | Larson et al. | 297/44 |
| 2002/0145316 | A1 * | 10/2002 | Oliver | 297/217.1 |
| 2003/0234032 | A1 * | 12/2003 | Booth | 135/16 |
| 2005/0073181 | A1 * | 4/2005 | Anton | 297/135 |
| 2011/0133523 | A1 * | 6/2011 | Crowe | 297/135 |
| 2013/0001987 | A1 * | 1/2013 | Heredia | 297/163 |

* cited by examiner

*Primary Examiner* — David R Dunn
*Assistant Examiner* — Jody Giacoman
(74) *Attorney, Agent, or Firm* — Law Offices of Morland C. Fischer

(57) ABSTRACT

The present invention is a foldable chair assembly for providing comfort to a user in outdoor environments comprising a folding chair having a frame structure defined by a pair of vertical front frame members coupled to a pair of vertical rear frame members by way of a plurality of pairs of cross frame members, a seating member extending between the pair of vertical front frame members and the pair of vertical rear frame members, a back rest, a pair of armrests, a cup holder, a plurality of foot pads, a front pocket, a side pocket, an umbrella attached to the folding chair through an umbrella loop of the back rest and an adjustable tray secured between the pair of vertical front frame members. The folding chair, the umbrella and the adjustable tray are arranged in a way to provide comfort to the user while reclining in outdoor environments.

13 Claims, 8 Drawing Sheets

ICHAIR

BACKGROUND OF THE DISCLOSURE

1. Technical Field of the Invention

The present embodiment relates in general to foldable chairs. More specifically, the present embodiment relates to a foldable chair assembly having an umbrella and an adjustable tray designed to hold handheld electronic devices and accessories while reclining in outdoor environments.

2. Description of the Related Art

Foldable chairs are specifically used for reclining in outdoor environments such as a beach, park etc. Several types of foldable beach chairs and lawn chairs are well-known in the art. Some of these chairs are equipped with sun shades to protect the user from sun or rain. Such sun shades are not easily adjustable which causes difficulty to the user. In addition, the chairs require too much space for storage.

Conventional foldable chairs have considerable drawbacks. For instance, an existing chair includes a seat portion, back portion and leg portions which is equipped with an adjustable sun shade attached to the back portion and a tray means secured to one of the leg portions of the chair by a mounting bracket. The sun shade and the tray of the foldable chair can be easily folded for storage purposes. While the foldable chair protects the user from sun and/or rain, the tray does not facilitate holding handheld devices in a manner similar to the present invention. Further, the chair does not provide any means for holding the accessories of the user.

A variant to this chair uses a combination umbrella and folding chair, including a chair section with a flexible and planar seat member, a flexible and planar backrest, an umbrella section and a ring-shaped cup holder. The assembly further includes a mechanism for storing and transporting the umbrella section and the chair section simultaneously. The combination provides a barrier between a user and the sun or rain while the user employs the chair in outdoor environments. However, the combination does not disclose an adjustable tray for allowing the user to place handheld electronic devices.

Another existing chair provides a folding canopy chair having a frame, a seat, a back, arm rests and an umbrella secured to the frame and is pivoted between an upright use position extending above the chair and a downward storage position adjacent the frame. The umbrella can be removably mounted on either the left or right side of the chair and provides shade from the sun for the user. A major drawback of this chair is that the umbrella cannot be separated from the chair, thereby making it difficult for storage and transport.

There are several other chairs designed to provide comfort to the users while resting in outdoor environments. Such chairs employ umbrellas to protect the user from sun and rain. Some other chairs include cup holders for beverages. However, the structure of these chairs is complex and hence cannot be easily assembled by the user. Further, such chairs do not provide chair, umbrella, tray and cup holder in a single convenient assembly.

Therefore it can be seen that there is a need for a foldable, portable chair having an adjustable tray and umbrella for placing handheld electronic devices such as laptops or tablet devices. Such a chair would include a cup holder for beverages. This needed chair would include a laptop pocket in the adjustable tray for holding handheld electronic devices. The foldable chair would also include pockets to hold the user's accessories. Such a chair would be made of a lightweight material and ultra-violet/water resistant fabric to protect the user from the sun and rain. In addition, the chair would be a simple structure, easily assembled, stored and carried by the user.

SUMMARY OF THE EMBODIMENT

The present invention is a foldable chair assembly for providing comfort to a user in outdoor environments. The foldable chair assembly comprises a folding chair defined by a frame structure having a pair of vertical front frame members coupled to a pair of vertical rear frame members by way of a plurality of pairs of cross frame members, a seating member extending between the pair of vertical front frame members and the pair of vertical rear frame members, a back rest disposed between the pair of vertical rear frame members, a pair of armrests positioned on each side of the seating member, a cup holder positioned on at least one of the pair of arm rests, a plurality of foot pads configured to couple the pair of vertical front frame members, the pair of vertical rear frame members and the plurality of pairs of cross frame members, a front pocket positioned on a lower front portion of the seating member, a side pocket positioned on a lower side portion of the seating member, an umbrella attached to the folding chair through an umbrella loop of the back rest and an adjustable tray secured between the pair of vertical front frame members. The folding chair, the umbrella and the adjustable tray are arranged in a way to provide comfort to the user while reclining in outdoor environments.

The cup holder is configured for holding beverages and each of the plurality of foot pads is configured to interconnect each of the pair of vertical front frame members, each of the pair of vertical rear frame members and each of the plurality of pairs of cross frame members. The adjustable tray includes a tray pocket for accommodating a handheld electronic device of the user and a tray cup holder for holding the beverages. The front pocket is configured to hold accessories of the user and the side pocket is also designed to hold accessories of the user. The umbrella is designed to protect the user from inclement weather and can be titled as desired by the user. The folding chair, the umbrella and the adjustable tray can be assembled to form the foldable chair assembly.

One objective of the present invention is to provide a foldable chair assembly having an umbrella and an adjustable tray designed to hold handheld electronic devices and accessories while reclining in outdoor environments.

A second objective of the present invention is to provide a foldable chair assembly that can be easily assembled by a user.

A third objective of the present invention is to provide light weight travel furniture.

Another objective of the present invention is to provide foldable chair assembly made of an ultraviolet and water resistant fabric.

Yet another objective of the present invention is to provide an umbrella that can protect the user from inclement weather.

Still another objective of the present invention is to provide an umbrella and an adjustable tray that can be easily tilted as desired by the user.

These and other advantages and features of the present invention are described with specificity so as to make the present invention understandable to one of ordinary skill in the art.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
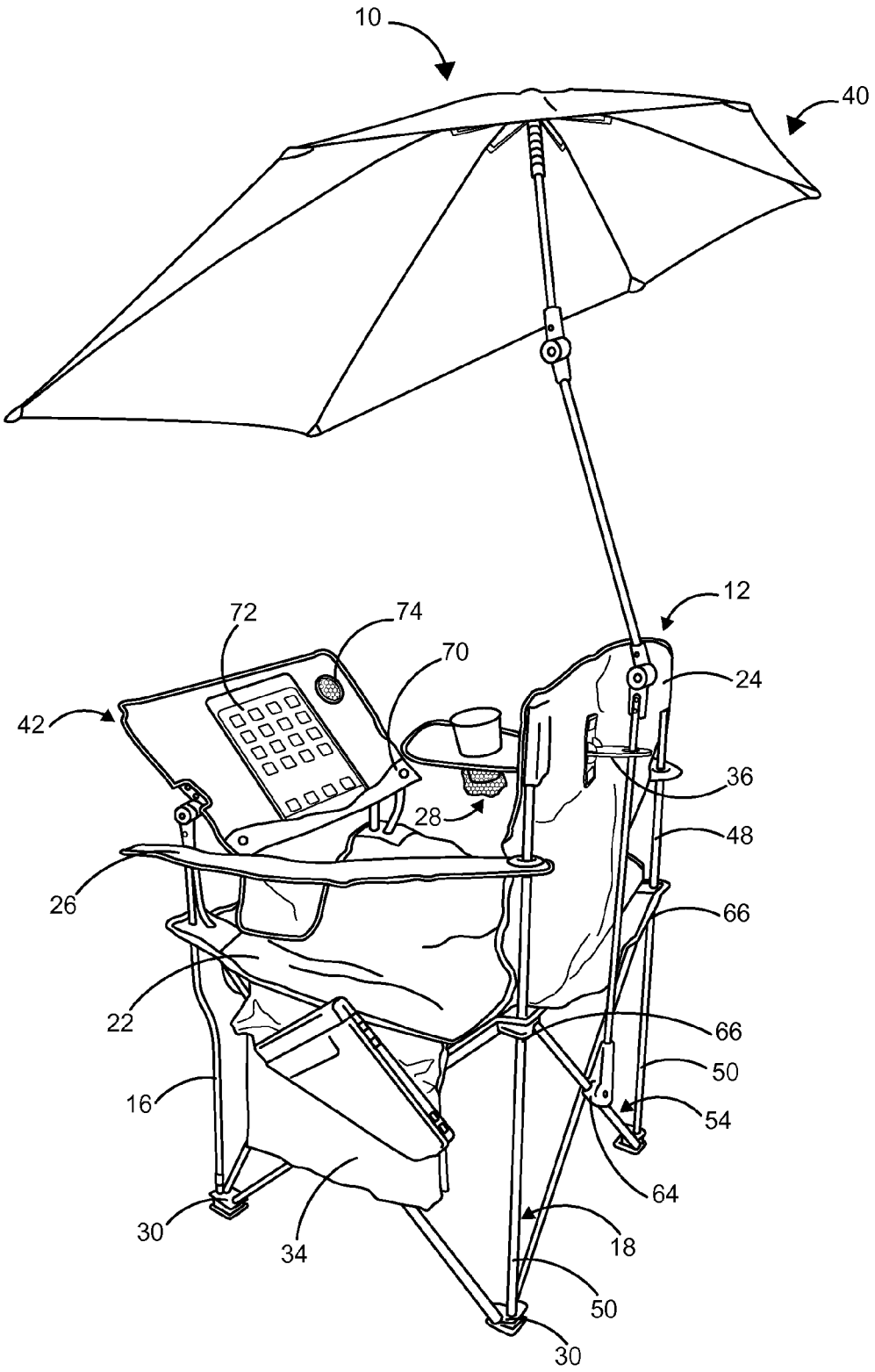
FIG. 1 illustrates a side perspective view of a foldable chair assembly of the present invention.

Referring to FIG. 1, a side perspective view of a foldable chair assembly 10 of the present invention is illustrated. The foldable chair assembly 10 comprises a folding chair 12 comprising a frame structure 14 having a pair of vertical front frame members 16 coupled to a pair of vertical rear frame members 18 by way of a plurality of pairs of cross frame members 20, a seating member 22 extending between the pair of vertical front frame members 16 and the pair of vertical rear frame members 18, a back rest 24 disposed between the pair of vertical rear frame members 18, a pair of armrests 26 positioned on each side of the seating member 22, a cup holder 28 positioned on at least one of the pair of armrests 26, a plurality of foot pads 30 configured to couple the pair of vertical front frame members 16, the pair of vertical rear frame members 18 and the plurality of pairs of cross frame members 20, a front pocket 32 positioned on a lower front portion of the seating member 38, a side pocket 34 positioned on a lower side portion of the seating member 22, an umbrella 40 attached to the folding chair 12 through an umbrella loop 36 of the back rest 24 and an adjustable tray 42 secured between the pair of vertical front frame members 16. The folding chair 12, the umbrella 40 and the adjustable tray 42 are arranged in a way to provide comfort to the user while reclining in outdoor environments.

Figure 2:
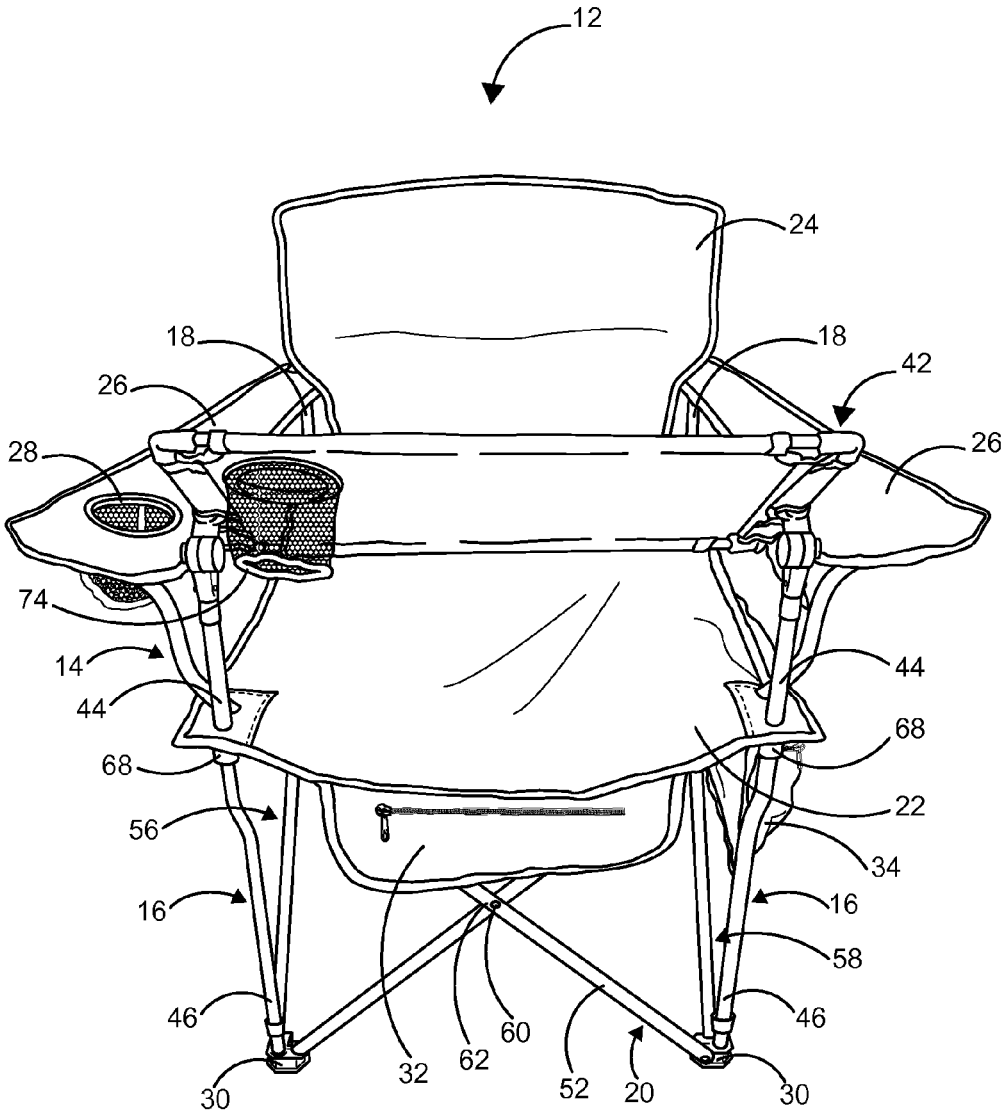
FIG. 2 illustrates a front perspective view of a folding chair of the foldable chair assembly of the present invention.

FIG. 2 illustrates a front perspective view of the folding chair 12 of the foldable chair assembly 10 of the present invention. The pair of vertical front frame members 16 comprises an upper portion 44 and a lower portion 46 and the pair of vertical rear frame members 18 also includes an upper portion 48 and a lower portion 50. The plurality of pairs of cross frame members 20 further comprises a pair of front cross frame members 52, a pair of rear cross frame members 54, a pair of left cross frame members 56 and a pair of right cross frame members 58. The pair of front cross members 52 is positioned between the lower portions 46 of the pair of vertical front frame members 16. The pair of front cross frame members 52 is diagonally joined together by means of a pivot 60 at a central portion 62 and is extended upward to form the pair of armrests 26. The pair of armrests 26 is positioned on each side of the seating member 22 and is terminated at the upper portion 48 of each of the pair of vertical rear frame members 18. The pair of rear cross frame members 54 is positioned between the lower portions 50, 50 of the pair of vertical rear frame members 18 and diagonally joined together by means of the pivot 60 at a central portion 64 and terminated at a top end 66 of the lower portion 50 of the pair of vertical rear frame members 18.

The pair of left cross frame members 56 is positioned between at least one of the pair of vertical front frame members 16 and at least one of the pair of vertical rear frame members 18 and diagonally joined together by means of the pivot 60 at a central portion and terminating at the top end of the lower portion 68 of at least one of the pair of vertical front frame members 16 and at a top end of the lower portion 66 of at least one of the pair of vertical rear frame members 18. The pair of right cross frame members 58 is positioned between at least one of the pair of vertical front frame members 16 and at least one of the pair of vertical rear frame members 18. The pair of right cross frame members 58 is diagonally joined together by means of the pivot 60 at a central portion and terminates at the top end of the lower portion 68 of at least one of the vertical front frame member 16 and the top end of the lower portion 66 of at least one of the vertical rear frame member 18. The cup holder 28 is configured for holding beverages so as to allow the user to place the beverages while resting in the folding chair assembly 10. The cup holder 28 may be placed on either one or both the armrests 26. Each of the plurality of foot pads 30 is configured to interconnect each of the pair of vertical front frame members 16, each of the pair of vertical rear frame members 18 and each of the plurality of pairs of cross frame members 20. The plurality of foot pads 30 is slip resistant which helps to prevent the slipping of the folding chair 12 on any floor surface.

Figure 3:
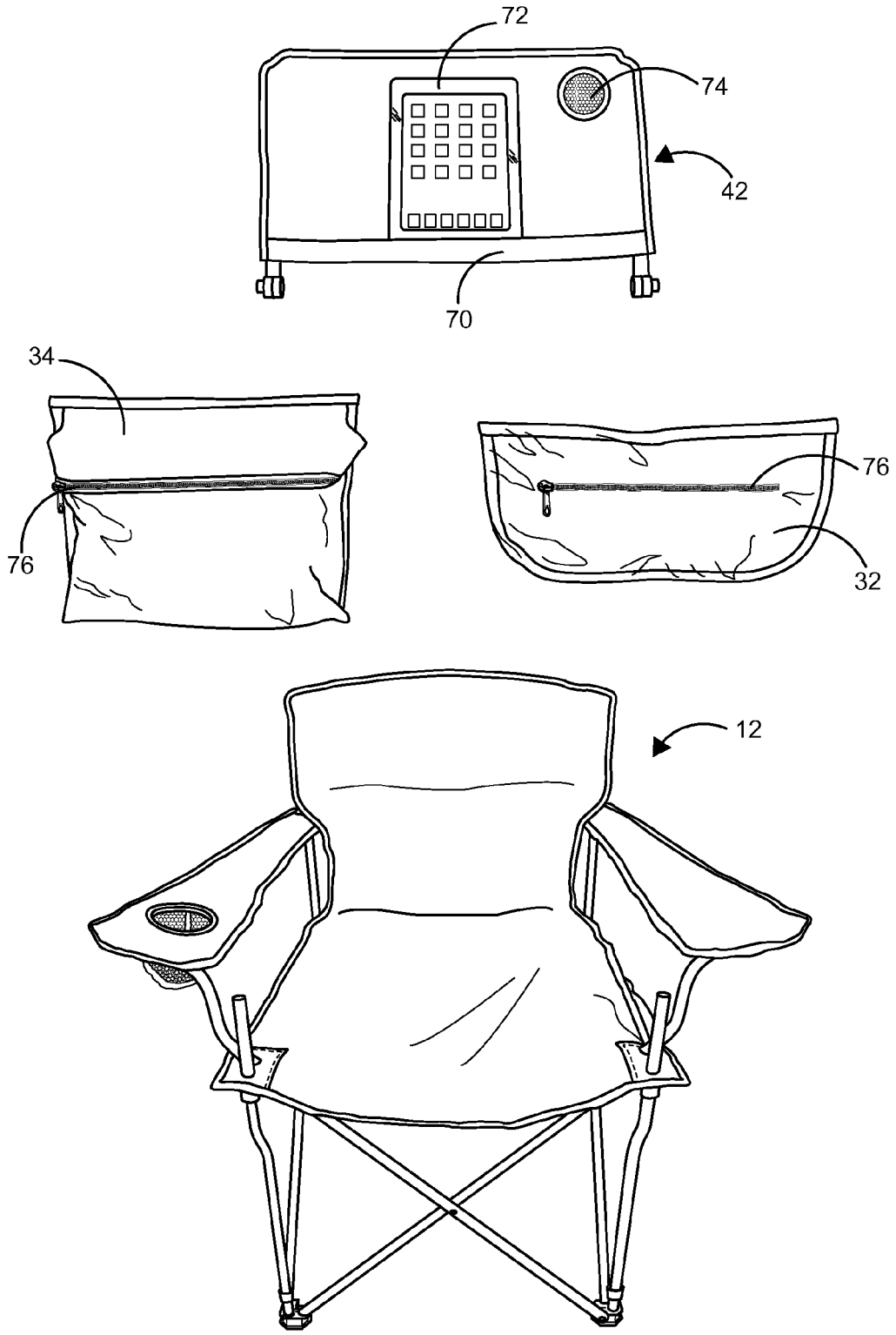
FIG. 3 illustrates an exploded view of the folding chair shown in FIG. 2.

FIG. 3 illustrates an exploded view of the folding chair 12 shown in FIG. 2. In this figure, the folding chair 12, the adjustable tray 42, the front pocket 32 and the side pocket 34 are shown separately. The adjustable tray 42 is configured to include a tray pocket 70 to accommodate a handheld electronic device 72 of the user. The handheld electronic device 72 may be selected from a group consisting of: laptops, tablet devices, I-phones and I-pads. The adjustable tray 42 further includes a tray cup holder 74 for holding the beverages. The front pocket 32 is configured to hold accessories of the user and the side pocket 34 is also designed to hold accessories of the user. The side pocket 34 is larger in size compared to the front pocket 32 and hence can hold large accessories such as books, file etc. The front pocket 32 allows the user to place small accessories such as mobile phones, pocket calculators etc. Both the front pocket 32 and the side pocket 34 may be opened and closed by means of a zipper 76 and allows the user to hold any accessories.

Figure 4A:
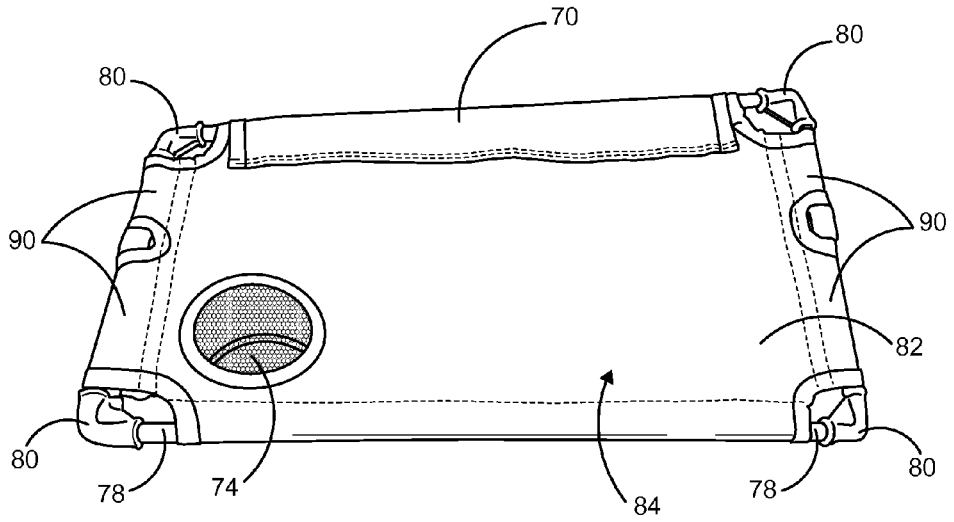
FIGS. 4A-4B illustrates top and bottom perspective views of the present invention, showing the adjustable tray.
Figure 4B:
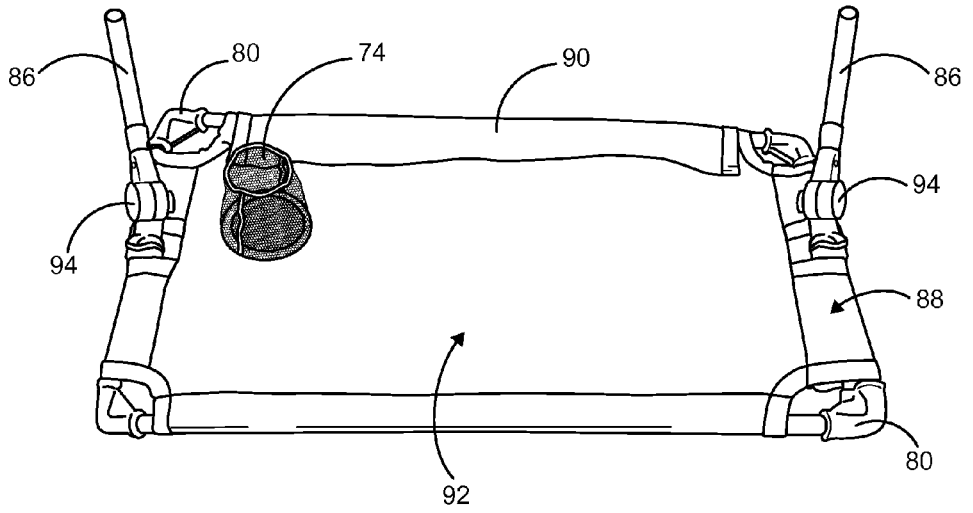

FIGS. 4A-4B illustrate top and bottom perspective views of the present invention, showing the adjustable tray 42. The adjustable tray 42 comprises a tray frame 78 joined together by means of a plurality of tray joints 80 and covered by means of a tray cover 82, the tray pocket 70 positioned on a front surface of the tray cover 84, the tray cup holder 74 positioned on the front surface of the tray cover 84, a pair of poles 86 positioned on a bottom portion of the adjustable tray 88 and a plurality of Velcro flaps 90 extending from the front surface 84 to a rear surface of the tray cover 92. The pair of poles 86 is designed to be inserted into the pair of vertical front frame members 16 by means of a hinge with a button 94 and the plurality of Velcro flaps 90 is designed for fastening the tray cover 82 to the tray frame 78. The tray pocket 70 can accommodate handheld electronic device of the user 72 and the tray cup holder 74 is configured to hold beverages.

Figure 5A:
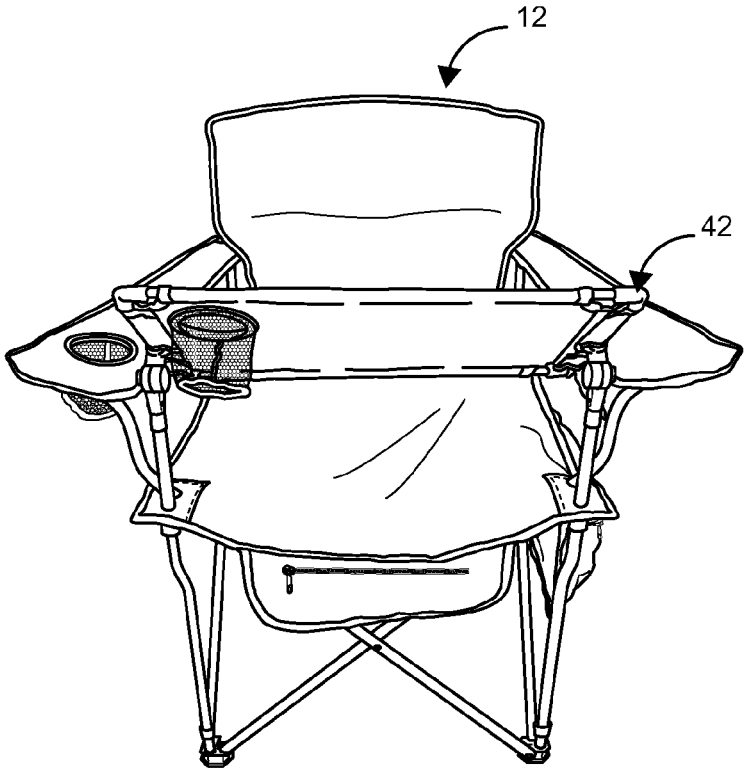
FIGS. 5A-5B illustrate perspective views of the present invention, showing the adjustable tray attached to the folding chair.
Figure 5B:
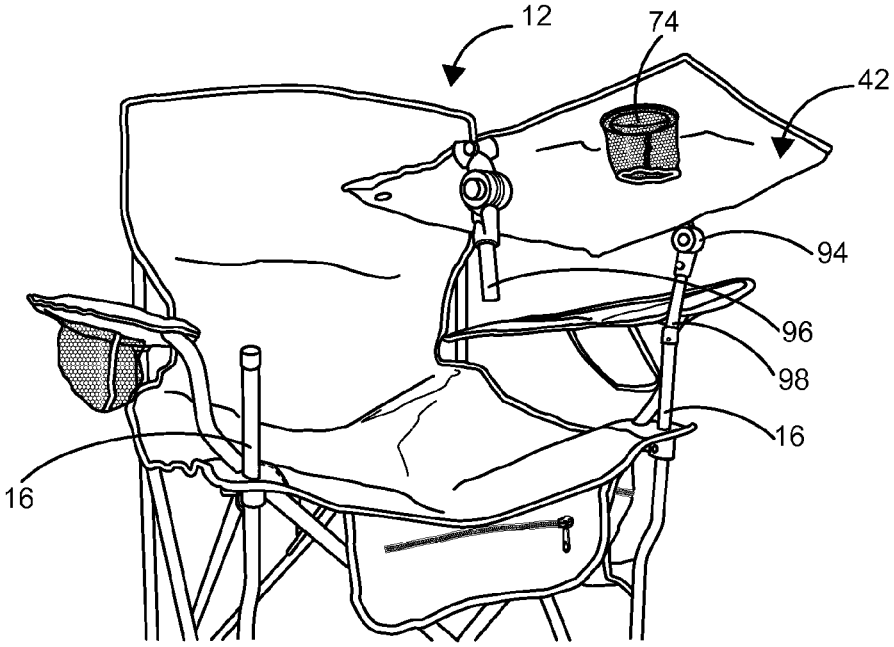

Turning to FIGS. 5A-5B, perspective views of the adjustable tray 42 attached to the folding chair 12 is illustrated. As shown in FIG. 5A, the adjustable tray 42 can be attached to the folding chair 12 by positioning the adjustable tray 42 between the pair of front frame members 16 and the pair of poles 86 is inserted into the pair of vertical front frame members 16 and secured by means of the hinge with button 94. The pair of poles 86 includes a left pole 96 and a right pole 98. The left pole 96 is approximately 50% smaller in length than the right pole 98 and hence can be easily unclipped from the one of the pair of the vertical front frame members 16 using the hinge 94. The left pole 96 is longer and hence remains clipped, completely secured to one of the pair of the vertical front frame members 16. The user can move in and out of the folding chair 12 by unclipping the left pole 96 and swiveling the tray frame 78 outwards. Thus, the pair of poles 86 allows easy movement in and out of the chair 12 by unclipping the left pole 96 and swiveling the tray 42. The plurality of Velcro flaps 90 can be unlatched to remove the tray cover 82 from the tray frame 78. The adjustable tray 42 can accommodate the handheld electronic device 72 and a beverage simultaneously and hence provides additional comfort to the user while reclining in outdoor environments such as beach, park etc.

Figure 6:
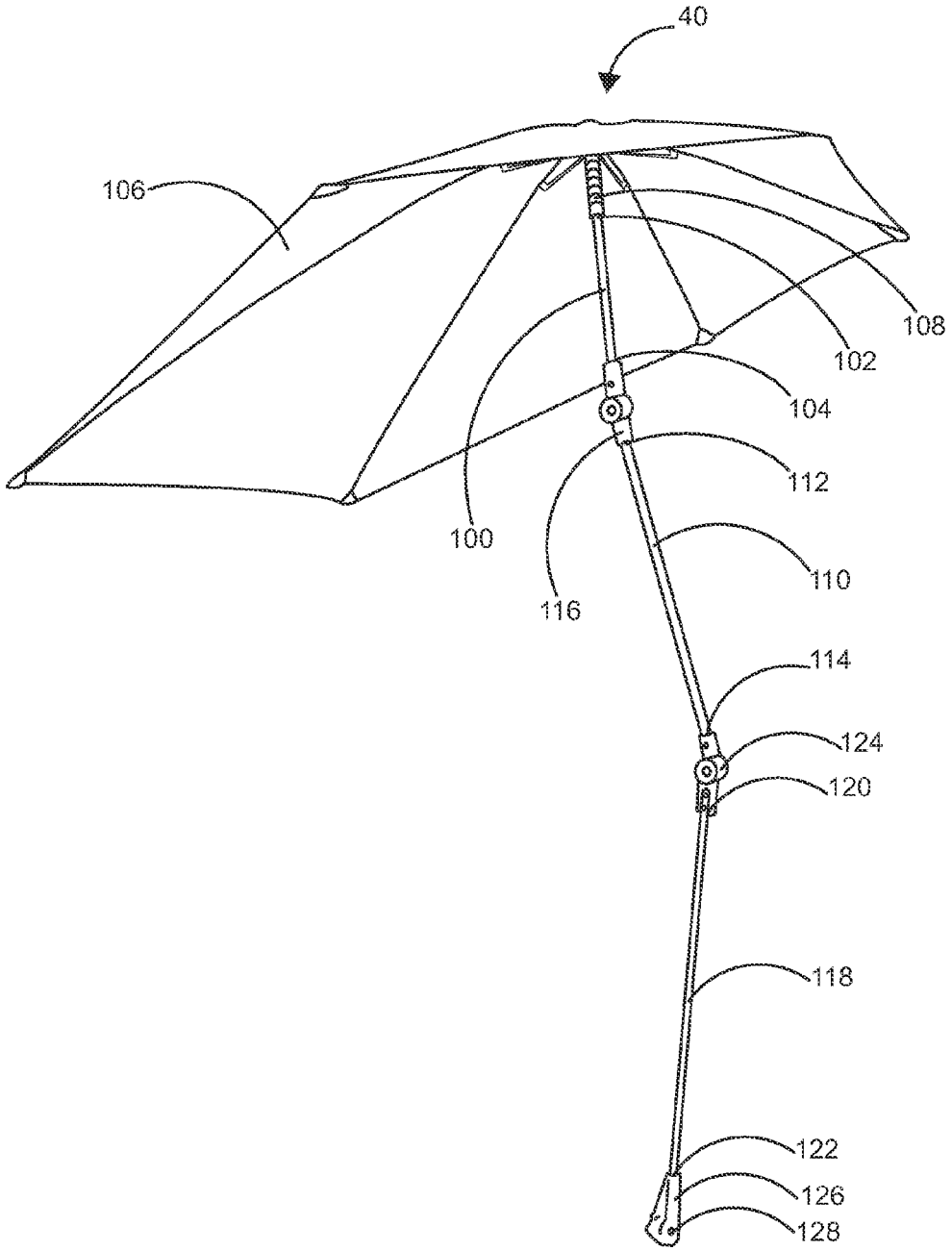
FIG. 6 illustrates a perspective view of an umbrella of the foldable chair assembly of the present invention.

FIG. 6 illustrates a perspective view of the umbrella 40 of the foldable chair assembly 10 of the present invention. The umbrella 40 comprises an upper pole 100 having a top end 102 and a bottom end 104, a covering 106 attached to the top end of the upper pole 102 by way of a connecting member 108, a middle pole 110 having a top end 112 and a bottom end 114 wherein the top end 112 is attached to the bottom end of the upper pole 104 by means of an upper hinge 116, a lower pole 118 having a top end 120 and a bottom end 122 wherein the top end 120 is attached to the bottom end of the middle pole 114 by means of a lower hinge 124 and a base portion 126 attached to the bottom end of the lower pole 122. The base portion 126 is permanently secured to the central portion of the pair of rear cross members 54. The umbrella 40 is designed to protect the user from inclement weather and can be titled as desired by the user. The umbrella 40 can be of any desired shape selected from a group consisting of: circular, rectangular, trapezoidal and the like.

Figure 7:
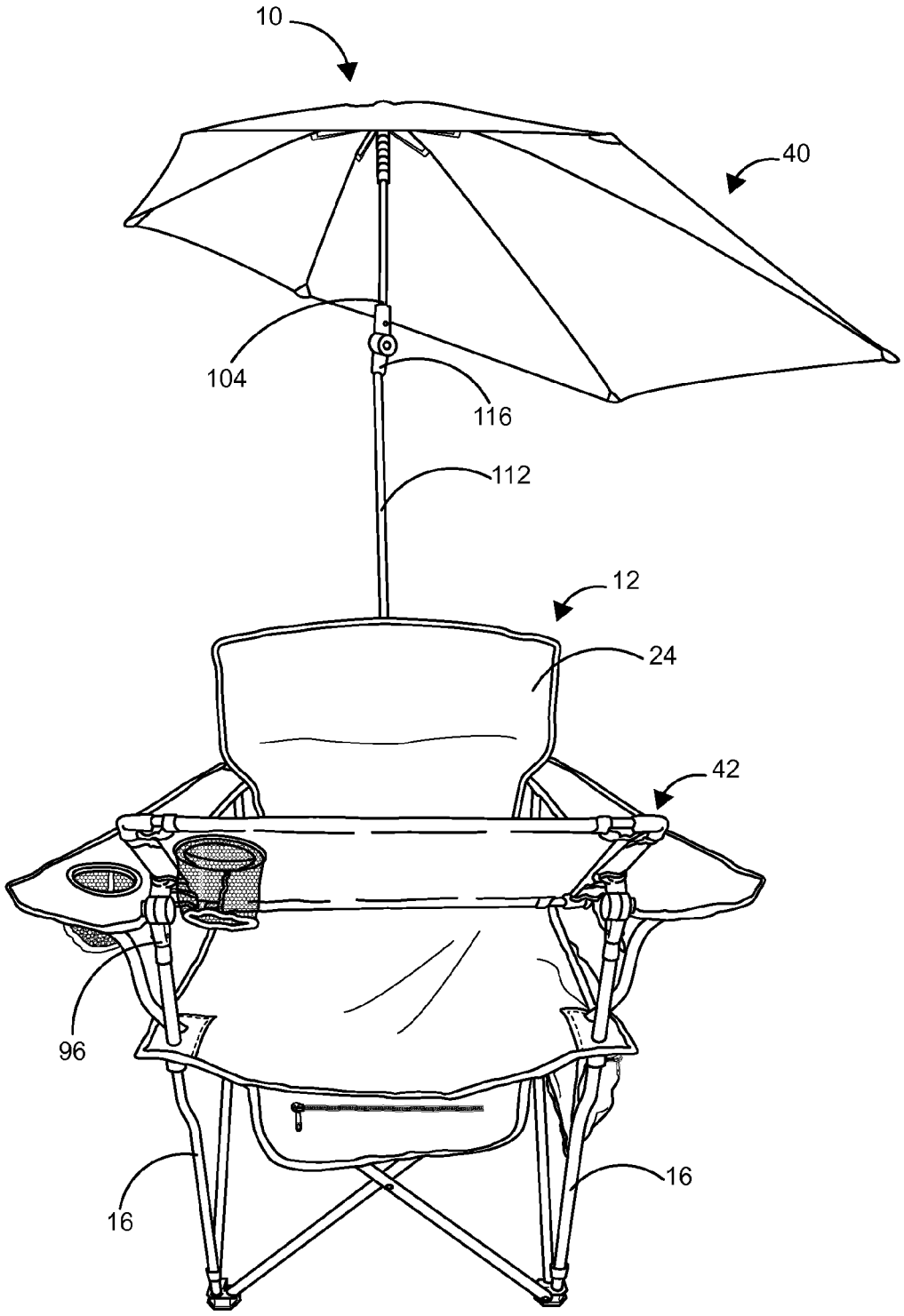
FIG. 7 illustrates a front perspective view of the foldable chair assembly of the present invention.

FIG. 7 illustrates a front perspective view of the foldable chair assembly 10 of the present invention. The foldable chair assembly 10 can be assembled by attaching the umbrella 40 to the folding chair 12 and then attaching the adjustable tray 42 to the folding chair 12. The umbrella 40 can be attached to the folding chair 12 by attaching the bottom end of the upper pole 104 to the top end of the middle pole 112 by means of the upper hinge 116. Next, the lower pole 118 is inserted through an umbrella loop 36 (FIG. 1) of the back rest 24. The bottom end of the middle pole 114 is then attached to the top end of the lower pole 120 by means of the lower hinge 124 and the top end of the upper pole 102 is attached to the covering 106 by way of the connecting member 108. Finally, the bottom end of the lower pole 122 and is attached by means of a push button 128 to the base portion 126 permanently secured to the folding chair 12. When the lower pole 122 is inserted into the base portion 126, the push button 128 aligns with a hole in the base portion 126 and pops out to secure the umbrella 40. The user can then sit on the folding chair 12 and attach the adjustable tray 42 to the folding chair 12 by inserting the pair of poles to the pair of the vertical, front frame members 16 and securing by means of the hinge with button 94. The user can tilt the adjustable tray 42 by unclipping the left pole 96 from one of the pair of vertical front frame members 16 and swiveling the tray 42. By swiveling the tray 42, the user can also move in and out of the chair. The adjustable tray 42 and the umbrella 40 can be adjusted as desired by the user.

Figure 8:
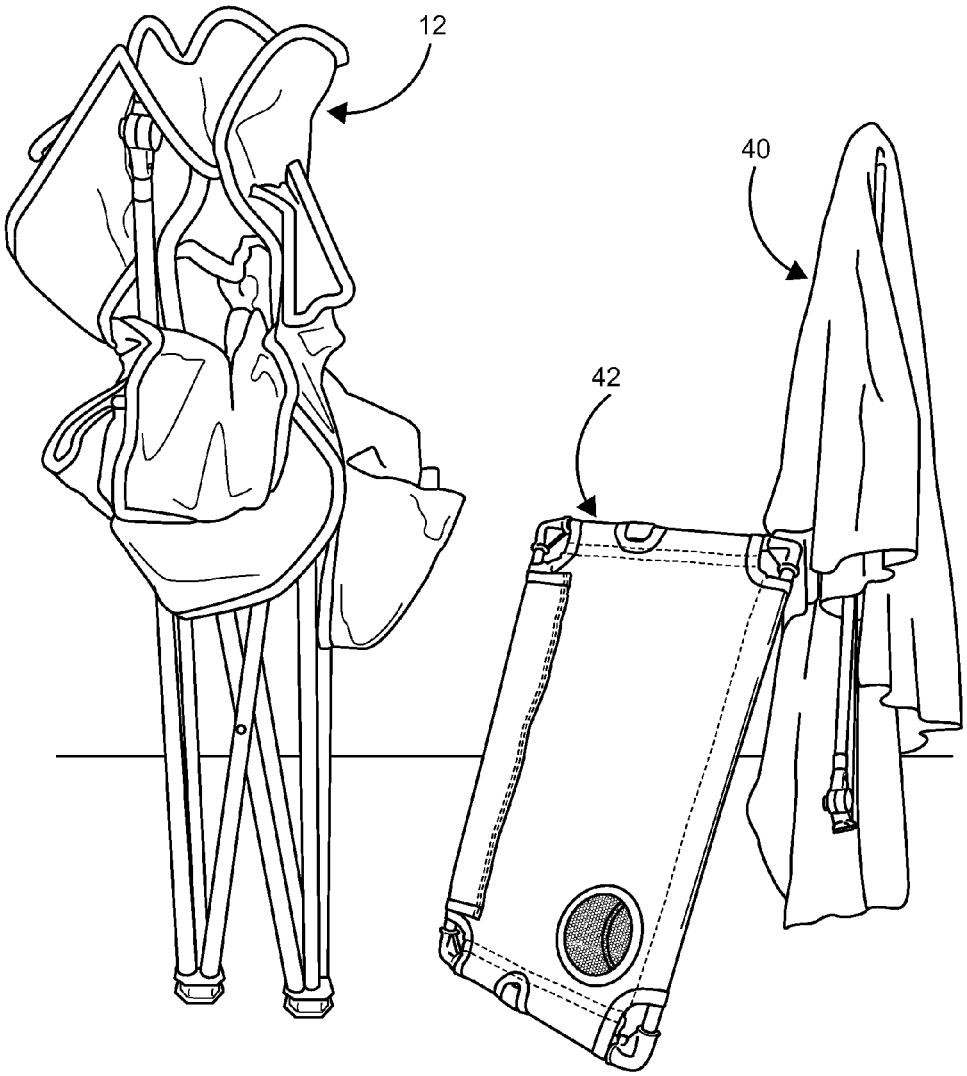
FIG. 8 illustrates an exploded view of the foldable chair assembly of the present invention, showing the folding and the umbrella in a folded position.

FIG. 8 illustrates an exploded view of the foldable chair assembly 10 of the present invention, showing the folding chair 12 and the umbrella 40 in folded position. The folding chair 12, the umbrella 40 and the adjustable tray 42 can be separately removed from the foldable chair assembly 10 for transport and storage. The folding chair 12 can be separately removed and folded when not in use. The foldable chair assembly 10 is light weight and hence can be easily assembled, stored and carried as simple travel furniture by the user. The foldable chair assembly 10 is made of an ultra violet and water resistant fabric and hence protects the user from inclement weather.

The foregoing description of the preferred embodiment of the present invention has been presented for the purpose of illustration and description. It is not intended to be exhaustive or to limit the invention to the precise form disclosed. Many modifications and variations are possible in light of the above teachings. For example, the adjustable tray 42 may be available with or without the tray cup holder 74. In addition, the adjustable tray 42 can be used as a food tray. Moreover, the folding chair 12, the umbrella 40 and the adjustable tray 42 can be folded and conveniently carried in a bag for transport and storage. It is intended that the scope of the present invention not be limited by this detailed description, but by the claims and the equivalents to the claims appended hereto.

What is claimed is:

1. A chair having a front, a rear and a pair of opposite sides, said chair comprising:

a frame including a pair of vertical front frame members, a pair of vertical rear frame members, a first pair of cross frame members by which to couple said pairs of vertical front and rear frame members to one another, and a second pair of cross frame members by which to couple said pair of vertical rear frame members to one another;

a seat extending between the pairs of vertical front and rear frame members;

a back rest attached to said pair of vertical rear frame members; and an adjustable tray carried by said frame above said seat at the front of said chair, said adjustable tray including a pair of tray connecting poles extending vertically from said adjustable tray and having first and opposite ends, the first ends of said tray connecting poles being pivotally attached to said adjustable tray, and the opposite ends of said pair of tray connecting poles being removably received by respective ones of said pair of vertical front frame members so that said adjustable tray is separated from said chair when the opposite ends of said pair of tray connecting poles are removed from said pair of vertical front frame members, and said adjustable tray being tilted around a horizontal axis that extends between said pair of vertical front frame members at which the opposite ends of said pair of tray connecting poles are removably received, wherein one of said pair of tray connecting poles is shorter in length extending vertically from said adjustable tray than the other one of said pair of tray connecting poles, the opposite end of the shorter one of said pair of tray connecting poles being removed from a first of said pair of vertical front frame members while the opposite end of the longer other one of said pair of tray connecting poles remains in receipt by the second of said pair of vertical front frame members, said adjustable tray pivoting around a vertical pivot axis established by the second of said pair of vertical front frame members so as to rotate away from the seat of said chair by means of the opposite end of the longer other one of said pair of tray connecting poles swiveling at the second of said pair of vertical front frame members.

2. The chair recited in claim 1, further comprising an umbrella and a vertical umbrella retaining pole lying behind the back rest of said chair, said umbrella retaining pole being detachably connected at one end thereof to one of said second pair of cross frame members at a location below said back rest and connected at the opposite end to said umbrella, such that said umbrella stands upwardly from said vertical umbrella retaining pole above said back rest, said umbrella retaining pole being detached from the one of said second pair of cross frame members so that said umbrella is separated from said chair.

3. The chair recited in claim 2, further comprising an umbrella loop surrounding said vertical umbrella retaining pole and connected to the back rest of said chair so as to hold said umbrella retaining pole behind said back rest.

4. The chair recited in claim 2, wherein the opposite end of said vertical umbrella retaining pole is pivotally connected to said umbrella by which said umbrella is tilted above said back rest relative to the user who is seated on the seat of said chair.

5. The chair recited in claim 1, further comprising a pair of arm rests located at each of the pair of opposite sides of said chair and extending between respective ones of said pairs of vertical front and rear frame members, and a cup holder carried by at least one of said pair of arm rests for receiving therewithin a beverage cup.

6. The chair recited in claim 1, further comprising a front pocket attached to and depending downwardly from the seat of said chair so as to lie between said pair of vertical front frame members.

7. The chair recited in claim 1, further comprising a side pocket attached to and depending downwardly from the seat of said chair so as to lie between one of said pair of vertical front frame members and one of said pair of vertical rear frame members which lies opposite the one of said pair of front frame members.

8. The chair recited in claim 1, further comprising a tray pocket attached to said adjustable tray and being sized to accommodate therewithin a hand-held electronic device.

9. The chair recited in claim 1, wherein said adjustable tray carries a cup holder for receiving therewithin a beverage cup.

10. A chair having a front, a rear and a pair of opposite sides, said chair comprising:

a frame including a pair of vertical front frame members, a pair of vertical rear frame members, a first pair of cross frame members by which to couple said pairs of vertical front and rear frame members to one another and a second pair of cross frame members located at the rear of said chair by which to couple said pair of vertical rear frame members to one another;

a seat extending between the pairs of vertical front and rear frame members;

a back rest attached to said pair of vertical rear frame members;

an adjustable tray carried by said frame above said seat at the front of said chair, and at least one tray connecting pole having first and opposite ends, the first end of said tray connecting pole being coupled to said adjustable tray by way of a first pivot and the opposite end of said tray connecting pole being slidably and removably received by a first of said pair of vertical front frame members, whereby said adjustable tray is tilted at said first pivot around a horizontal axis that runs in a direction extending between said pair of vertical front frame members, and said adjustable tray is rotatable relative to the first of said pair of vertical front frame members within which the opposite end of said tray connecting pole is slidably and removably received to enable a user to enter or exit the chair, and the opposite end of said tray connecting pole is removable from the first of said pair of front frame members so that said adjustable tray is separated from said chair;

an umbrella; and an umbrella retaining pole located behind the back rest of said chair and having first and opposite ends, the first end of said umbrella retaining pole being detachably connected to one of the second pair of cross frame members at the rear of said chair, and the opposite end of said umbrella retaining pole being connected to said umbrella, such that said umbrella stands upwardly from said umbrella retaining pole above said back rest, the first end of said umbrella retaining pole being detached from the one of said second pair of cross frame members so that said umbrella is separated from said chair.

11. The chair recited in claim 10, wherein there is a second tray connecting pole having first and opposite ends, the first end of said second tray connecting pole being coupled to said adjustable tray by way of a second pivot, and the opposite end of said second tray connecting pole being slidably and removably received by the second of said pair of vertical front frame members.

12. The chair recited in claim 11, wherein the second of said first and second tray connecting poles is shorter than the first, the shorter second of said tray connecting poles being removed from the second of said pair of vertical front frame members so that said adjustable tray is rotatable away from the seat of said chair by the longer first of said tray connecting poles swiveling within the first of said pair of vertical front frame members.

13. A chair having a front, a rear and a pair of opposite sides, said chair comprising:

a frame including a pair of vertical front frame members, a pair of vertical rear frame members, a first pair of cross frame members by which to couple said pairs of vertical front and rear frame members to one another, and a second pair of cross frame members by which to couple said pair of vertical rear frame members to one another;

a seat extending between the pairs of vertical front and rear frame members;

a back rest attached to said pair of vertical rear frame members; and an adjustable tray carried by said frame above said seat at the front of said chair, said adjustable tray being connected to at least one of said pair of vertical front frame members by way of a pivot so that said tray is tilted at said pivot around a horizontal axis that runs in a direction extending between said pair of vertical front frame members, and said adjustable tray is rotatable with respect to the one of said pair of vertical front frame members to which said adjustable tray is connected to enable a user to enter or exit the chair, and said adjustable tray is detachable from the one of said pair of vertical front frame members so as to be separated from said chair;

an umbrella;

an umbrella retaining pole lying behind the back rest of said chair and having first and opposite ends, the first end of said umbrella retaining pole being detachably connected to one of said second pair of cross members and the opposite end of said umbrella retaining pole being connected to said umbrella, such that said umbrella stands upwardly from said umbrella retaining pole above said back rest, the opposite end of said umbrella retaining pole being detached from the one of said second pair of cross frame members so that said umbrella is separated from said chair; and an umbrella loop surrounding said vertical umbrella retaining pole and connected to the back rest of said chair so as to hold said umbrella retaining pole behind said back rest.

* * * * *